US007143547B2

(12) United States Patent
Liles, Jr.

(10) Patent No.: US 7,143,547 B2
(45) Date of Patent: Dec. 5, 2006

(54) SPRING ASSISTED SWING DOOR OPERATOR

(75) Inventor: William S. Liles, Jr., Corpus Christi, TX (US)

(73) Assignee: Overhead Door Corporation, Lewisville, TX (US)

( * ) Notice: Subject to any disclaimer, the term of this patent is extended or adjusted under 35 U.S.C. 154(b) by 110 days.

(21) Appl. No.: 10/749,636

(22) Filed: Dec. 31, 2003

(65) Prior Publication Data

US 2005/0144847 A1 Jul. 7, 2005

(51) Int. Cl.
*E05F 11/24* (2006.01)

(52) U.S. Cl. ..... 49/340; 49/386

(58) Field of Classification Search ..... 49/339, 49/340, 325, 324, 386
See application file for complete search history.

(56) References Cited

U.S. PATENT DOCUMENTS 3,087,720 A 4/1963 Catlett
3,142,095 A * 7/1964 Sawyer ..... 49/366
3,237,932 A 3/1966 Catlett
3,369,323 A 2/1968 Millard et al.
3,864,875 A * 2/1975 Hewitt ..... 49/115
4,045,914 A 9/1977 Catlett
4,134,232 A * 1/1979 Dodge et al. ..... 49/386
4,220,051 A 9/1980 Catlett
4,333,270 A 6/1982 Catlett
4,349,296 A * 9/1982 Langeman ..... 405/99
4,519,164 A * 5/1985 Porter ..... 49/108
4,599,824 A 7/1986 Mitsuhashi et al.
5,134,805 A * 8/1992 Frantzen et al. ..... 49/386
5,193,647 A 3/1993 O'Brien, II
5,927,016 A * 7/1999 Borgen ..... 49/346
6,336,294 B1 * 1/2002 Kowalczyk et al. ..... 49/339

* cited by examiner

*Primary Examiner*—Gregory J. Strimbu
(74) *Attorney, Agent, or Firm*—Gardere Wynne Sewell LLP

(57) ABSTRACT

A motorized universal swing door operator includes a motor driving a gear reduction drive mechanism having an output shaft adapted to be connected to a swing door operating arm. The output shaft supports a sprocket around which is trained a chain having opposite ends connected to a link supported on a shaft which is connected to a return spring. The return spring stores and returns energy regardless of the direction of rotation of the output shaft so as to provide the universal operating capability of the operator.

8 Claims, 3 Drawing Sheets

SPRING ASSISTED SWING DOOR OPERATOR

BACKGROUND OF THE INVENTION

Motorized operators are widely used for controlling the movement of swing doors by remote or automatic control. Typically, swing door operators include an electric motor driving an output shaft through a reduction gear drive for controlling movement of the door between a closed position and an open position, the operator also including a return spring or the like for at least assisting the motor to move the door to the closed position. Several types of swing door operator mechanisms have been developed but prior art operators tend to be mechanically complicated, particularly if adapted for so called universal applications, that is, applications where the operator may be reversed in its working position for swinging doors of opposite "hands" or for controlling doors to swing inwardly or outwardly with respect to the operator, and/or the door frame.

It is desirable to provide a swing door operator with low maintenance requirements, and which may be easily adapted for controlling doors in inswing and outswing applications and where the swing movement of the door is of one hand or the other without modification to the operator and while the operator remains reliable for a long life. It is to these ends that the present invention has been developed.

SUMMARY OF THE INVENTION

The present invention provides an improved swing door operator including a mechanism operable for returning the door from an open position to a closed position regardless of the hand or swing direction of the door.

In accordance with one aspect of the present invention a motorized swing door operator is provided which includes a frame which may be mounted on a support member for controlling doors of one hand or the other without major modifications to the operator. The operator is characterized by a frame which supports an electric drive motor driving an output shaft through a reduction gear drive wherein the output shaft of the operator is drivingly connected to a return spring by way of a mechanism including a flexible member, such as a chain trained over a sprocket, connected to the output shaft. The mechanism is mechanically uncomplicated and provides for use of the operator for controlling doors of opposite hand or swing direction when moving from a closed position to an open position and back to a closed position.

In accordance with another aspect of the present invention a motorized swing door operator is provided which comprises a frame for supporting a speed reduction gear drive mechanism, a drive motor, a single return spring and a mechanism for storing energy in the spring and returning the spring energy to the operator for moving the door in one direction or the other. The frame may be conveniently mounted on a support plate in two opposed positions, depending on the so-called "hand" of the door to be operated.

The present invention also provides a swing door operator which is mechanically uncomplicated, compact, reliable in operation and easily modified as to its working position for controlling an inswing door, an outswing door, and for controlling a door regardless of the direction of swing movement or so-called hand of the door.

Those skilled in the art will further appreciate the advantages and superior features of the invention as well as other important aspects thereof upon reading the detailed description which follows in conjunction with the drawings.

DETAILED DESCRIPTION OF THE PREFERRED EMBODIMENT

Figure 1:
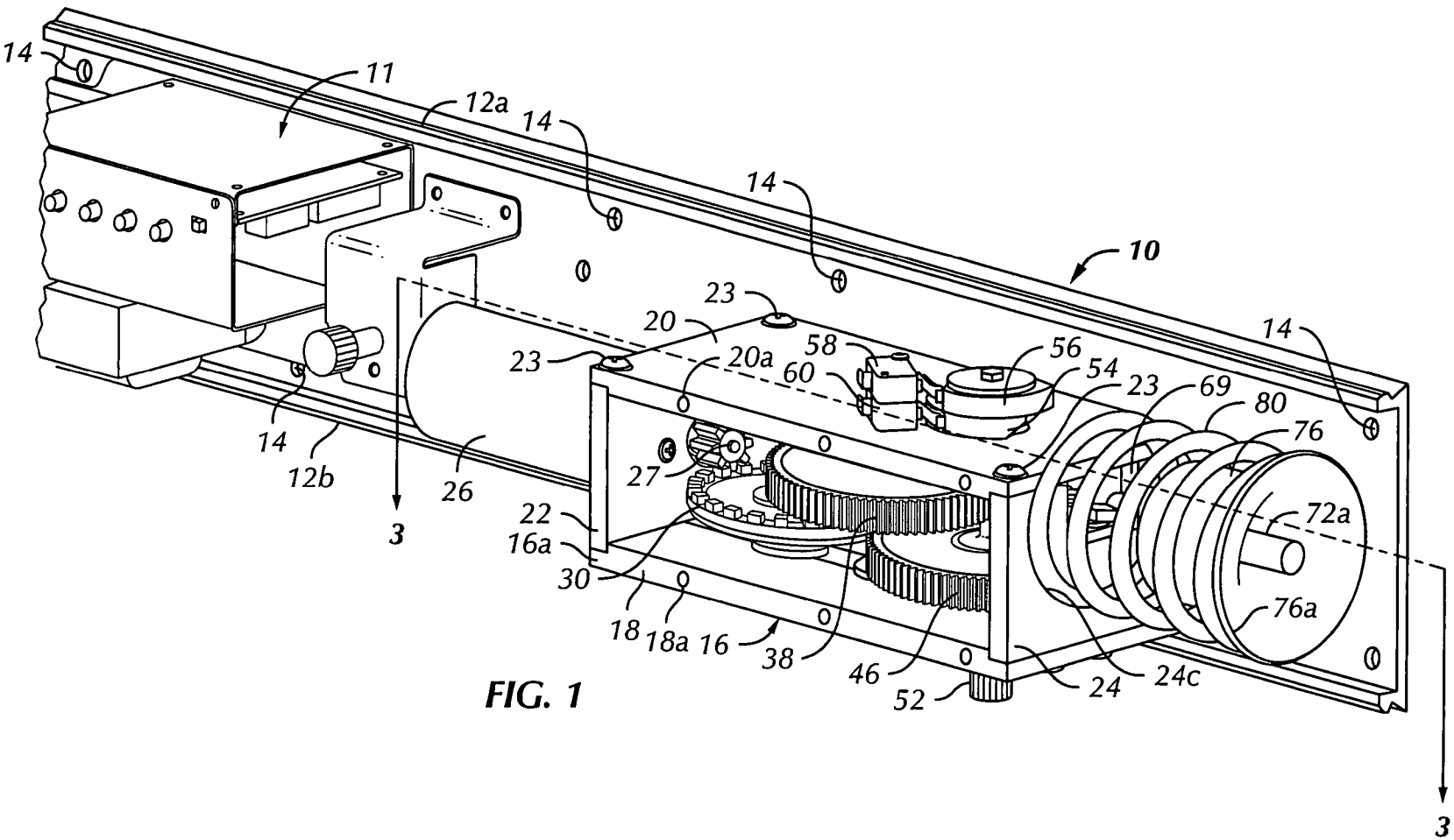
FIG. 1 is a perspective view of a swing door operator in accordance with the present invention.

In the description which follows like parts are marked throughout the specification and drawings with the same reference numerals, respectively. The drawing figures may not necessarily be to scale and certain elements may be shown in generalized or schematic form in the interest of clarity and conciseness.

Figure 2:
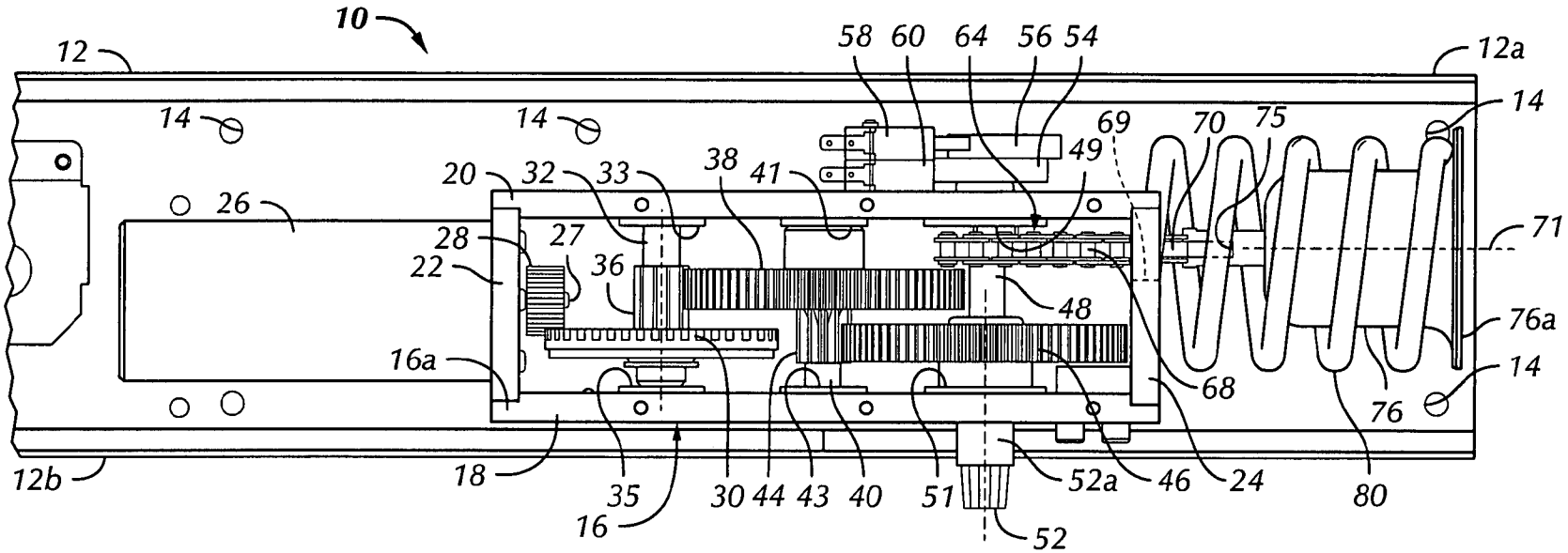
FIG. 2 is a front elevation view of the swing door operator shown in FIG. 1.

Referring to FIGS. 1 and 2, there is illustrated a swing door operator in accordance with the invention and generally designated by the numeral 10. The operator 10 includes an elongated, generally rectangular support plate member 12 which is adapted to mount on a door frame, not shown, generally above a swing door in a conventional manner known to those skilled in the art. The support plate 12 is provided with plural spaced apart fastener receiving holes 14, several shown in FIGS. 1 and 2, for receiving fasteners, not shown, for securing the support plate to a door frame or door jamb. Support plate 12 is adapted to support an operator frame, generally designated by the numeral 16, which is reversely mountable on the support plate 12 as will be described in further detail herein. Support plate 12 includes spaced apart flanges 12*a* and 12*b* configured for receiving a snap-on removable cover, not shown, for the operator 10.

The operator frame 16 is characterized by spaced apart, generally horizontally extending frame plate members 18 and 20 which are spaced apart by opposed end plates 22 and 24. The frame plates 18 and 20 are suitably secured to the frame plates 22 and 24 by conventional mechanical fastener 23, several shown in FIG. 1. Frame 16 may be reversely mounted on support plate 12 at opposed faces 16*a* and 16*b*, FIGS. 1 and 3, by fasteners 16*c*, FIG. 3, one shown, which may be threadedly engaged in opposed bores 18*a* and 20*a* formed in plates 18 and 20, FIG. 1.

The operator frame 16 supports an electric drive motor 26 having a rotatable output shaft 27 drivably connected to a pinion 28. Drive pinion 28 is meshed with a face gear 30 which is mounted on and drivingly connected to a shaft 32, FIG. 2. Shaft 32 is adapted for rotation about an axis perpendicular to the axis of rotation of pinion 28 and motor output shaft 27. Shaft 32 is mounted in suitable bearings 33 and 35 which, in turn, are supported in the frame plates 20 and 18, respectively. As shown in FIG. 2, shaft 32 also drivingly supports a second stage pinion 36 which is meshed with a gear 38. Gear 38 is mounted on an intermediate shaft 40 supported for rotation parallel to shaft 32 in spaced apart bearings 41 and 43 supported on the respective frame plates 20 and 18.

Referring further to FIG. 2, intermediate shaft 40 is also adapted to drivingly support a third stage pinion 44 and third stage pinion 44 is meshed with a gear 46 which is supported on a rotatable operator output shaft 48 mounted parallel to shaft 40 in suitable bearings 49 and 51 mounted on frame plates 20 and 18, respectively. Output shaft 48 is provided with a suitable drive part 52, such as a tapered polygonal cross section distal end of shaft 48, and adapted to be connected to a swing door power arm, not shown, for the operator 10. Output shaft 48 also supports spaced apart rotary cams 54 and 56 at its opposite end for rotation with shaft 48 and engagable with respective door position limit switches 58 and 60, see FIGS. 1 and 2.

Figure 3:
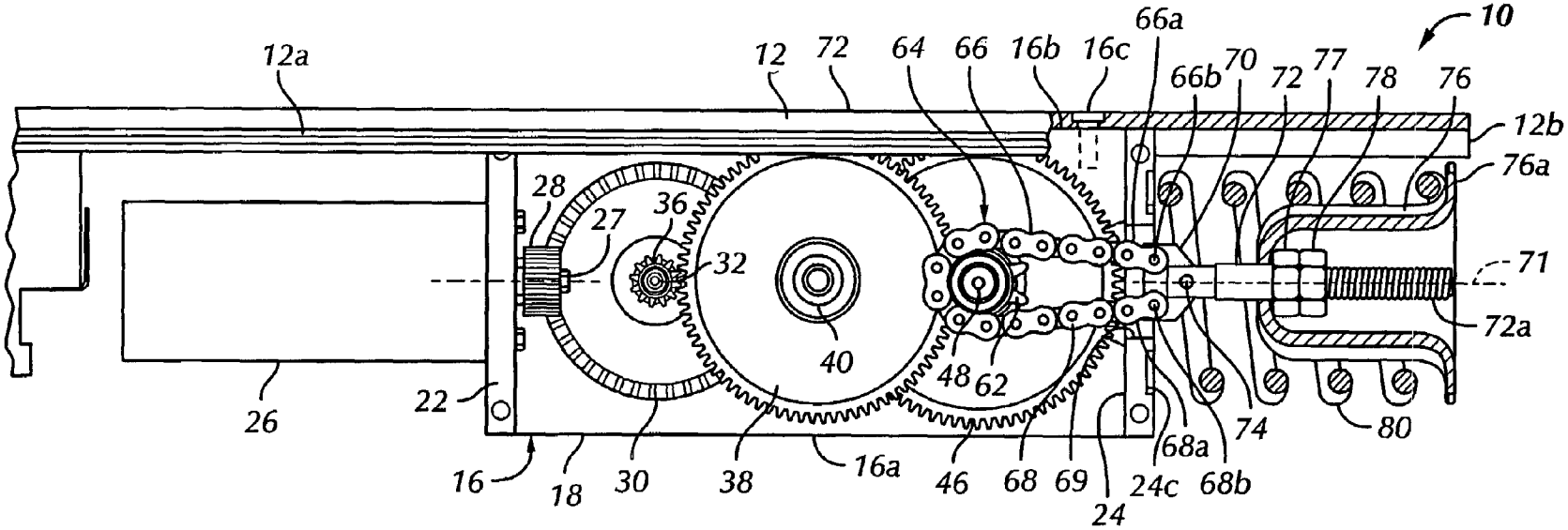
FIG. 3 is view taken generally along the line 3—3 of FIG. 1.

Referring also to FIG. 3, output shaft 48 is adapted to drivingly support a sprocket 62 suitably keyed for rotation with output shaft 48. In FIG. 3, frame plate 20 has been removed to provide for viewing certain components described herein. Sprocket 62 is engaged with an elongated flexible member comprising a conventional roller chain 64 which is trained around sprocket 62 and is characterized by opposed chain runs 66 and 68, FIG. 3. Respective chain runs 66 and 68 extend through an opening 69 in end plate 24 and terminate at a pivot link member 70, FIG. 3. Chain links 66*a* and 68*a* are suitably connected to the member 70 at spaced apart points on opposite sides of an axis 71 by respective pin members 66*b* and 68*b*, FIG. 3.

Referring further to FIGS. 2 and 3, link member 70 is mounted for limited pivotal movement on one end of a return spring transfer shaft 72 by a suitable pivot pin 74, FIG. 3. Link member 70 is disposed in a suitable slot 75, FIG. 2 which opens to the distal end of the shaft 72. As further shown in FIGS. 2 and 3, return spring transfer shaft 72 extends through a suitable bore formed in a spring cup member 76 and is secured in engagement with cup member 76 by a hex nut 77 and a locknut 78, both disposed on a threaded portion 72*a* of shaft 72 formed generally on the end of shaft 72 opposite the slot 75. Cup member 76 is provided with a transverse flange 76*a* engageable with one end of an energy storage member comprising a coil compression spring 80. The opposite end of spring 80 is forcibly engaged with frame plate 24. Frame plate 24 is preferably provided with a circumferential groove 24*c* for locating and retaining the return spring 80 in its working position.

As will be appreciated by those skilled in the art, the position of the nuts 77 and 78 on shaft 72 may be adjusted for adjusting the position of cup member 76 to provide a predetermined preload force on spring 80 which is reacted through the cup member 76 and shaft 72 to the chain 64 to properly tension the chain runs 66 and 68. Alternatively, or additionally, the spring 80 may be replaced by springs of different lengths and spring rates to provide the requisite door closing force, which force is transferred as a torque by way of chain 64, sprocket 62 and shaft 48.

In operation, the operator 10 is suitably controlled by a control unit, generally designated by the numeral 11 in FIG. 1, to energize the motor 26 upon receiving a command from a remote controlled switch or an automatic sensor, for example, both not shown. Energization of motor 26 rotates pinion 28 which rotates gears 30, 36, 38, 44 and 46 to provide a high torque low speed rotation effort exerted on shaft 48. Shaft 48 will rotate in one direction or the other, clockwise, for example in FIG. 3, whereby chain run 66 becomes slack while chain run 68 becomes taut and pulls the shaft 72 and spring retainer or cup member 76 toward frame plate 24 thus compressing spring 80 and storing energy therein. Specifically, the operation typically results in a door controlled by the operator 10 to be moved from a closed position to an open position as shaft 48 rotates approximately ninety degrees to one hundred twenty degrees about its axis 52*a*, FIG. 2.

When the door, not shown, reaches its open position one of switches 58 or 60 is actuated by its associated cam 54 or 56 which may result in control unit 11 energizing the motor 26 to apply braking power to hold the door in an open position, preferably for a predetermined period of time. Once the motor 26 is de-energized or energized at low power in the opposite direction of rotation of pinion 28, energy stored in spring 80 will cause shaft 72 to translate to the right, viewing FIG. 3. Since chain run 68 is taut while chain run 66 is relaxed, the sprocket 62 will rotate in a counter-clockwise direction driving the shaft 48 and associated power arm, not shown, attached thereto also in the counter-clockwise direction to return the door to its closed position.

Those skilled in the art will appreciate that the operation just described may be reversed in its entirety. For example, upon driving the pinion 28 in the opposite direction from that just described during the operation to rotate the shaft 48 in the opposite direction, the chain run 68 will become slack while chain run 66 becomes taut and pulls shaft 72 and cup member 76 toward frame plate 24 also compressing spring 80. Energy stored in spring 80 is thus returned to shaft 48 to rotate it in the opposite direction when the control unit 11 indicates that the aforementioned door is to be closed. In this way doors of opposite hand or direction of swing may be controlled by the operator 10 as needed, without any significant modification to the operator or adjustment thereof. Moreover, those skilled in the art will also appreciate the mechanical simplicity and dependability of the mechanism for providing storing of energy in spring 80 and returning energy from spring 80 during door opening and closing operations.

The fabrication and operation of the operator 10 is believed to be within the purview of one skilled in the art based on the foregoing description. Conventional engineering materials may be used to fabricate the components described herein as well as conventional mechanical assembly and disassembly procedures. Those skilled in the art will also recognize that the roller chain 64 and sprocket 62 may be replaced by various members, including but not limited to a cog belt and drive pulley, for example, or other types of chains and sprockets.

Although a preferred embodiment of the invention has been described in detail, those skilled in the art will also recognize that various substitutions and modifications may be made without departing from the scope and spirit of the appended claims.

What is claimed is:

1. A motorized operator for a swing door comprising:

a frame;

a motor supported on said frame;

a gear reduction drive mechanism supported on said frame and drivenly connected to said motor, said gear reduction drive mechanism including an output shaft having a part configured for connection to the door for moving said door in one direction and an opposite direction;

a sprocket connected to said output shaft and drivingly engaged with a chain partially wrapped around said sprocket, said chain having opposed runs;

a single coil spring supported on said frame;

an elongated shaft supporting a member engaged with said spring at one end of said spring for transmitting forces to and from said spring through said elongated shaft; and a link member connected to said elongated shaft and directly connected to said opposed runs of said chain, whereby, in response to rotation of said output shaft in a first direction one of said runs becomes taut and the other run becomes slack to compress said spring and store energy in said spring, and said spring is operable to return said energy through said one run to said output shaft to rotate said output shaft in a second direction opposite to said first direction for assisting movement of said door.

2. The operator set forth in claim 1 wherein:

said link member is mounted for limited pivotal movement on an end of said elongated shaft.

3. The operator set forth claim 1 wherein:

said frame includes a pair of spaced apart plates for supporting parallel shafts of said gear reduction drive mechanism and for supporting said output shaft.

4. The operator set forth in claim 3 wherein:

said frame includes opposed end plates connected to said pair of spaced apart plates, one of said end plates supporting said motor and the other end plate operably engaged with said spring.

5. The operator set forth claim 4 wherein:

said frame includes opposed faces each selectively mountable on a support plate for selective positioning of said frame with respect to said support plate.

6. The operator set forth in claim 1 wherein:

said chain comprises a roller chain.

7. A motorized operator for a swing door comprising:

a frame;

a motor supported on said frame;

a gear reduction drive mechanism supported on said frame and drivenly connected to said motor, said gear reduction drive mechanism including an output shaft having a part configured for connection to said door for moving said door in one direction and in an opposite direction;

a sprocket connected to said output shaft and drivingly engaged with a roller chain partially wrapped around said sprocket, said chain having opposed runs;

a single coil spring supported on said frame;

an elongated shaft supporting a member engaged with said spring at one end of said spring for transmitting forces to and from said spring through said elongated shaft; and a link member mounted for limited pivotal movement on said elongated shaft and directly connected to said opposed runs of said chain, whereby, in response to rotation of said output shaft in a first direction one of said runs becomes taut and the other run becomes slack to compress said spring and store energy in said spring, and said spring is operable to return said energy through said one run to said output shaft to rotate said output shaft in a second direction opposite to said first direction for assisting movement of said door.

8. A motorized operator for a swing door comprising:

a frame including a pair of spaced apart plates and opposed end plates connected to said pair of spaced apart plates;

a motor supported on said frame at one of said end plates;

a gear reduction drive mechanism supported on said spaced apart plates and drivenly connected to said motor, said gear reduction drive mechanism including an output shaft having a part configured for connection to said door for moving said door in one direction and in an opposite direction;

a sprocket connected to said output shaft and drivingly engaged with a chain partially wrapped around said sprocket, said chain having opposed runs;

a single coil spring supported on said frame at the other of said end plates;

an elongated shaft supporting a member engaged with said spring at one end of said spring for transmitting forces to and from said spring through said elongated shaft; and a link member connected to said elongated shaft and directly connected to said opposed runs of said chain, whereby, in response to rotation of said output shaft in a first direction one of said runs becomes taut and the other run becomes slack to compress said spring and store energy in said spring, and said spring is operable to return said energy through said one run to said output shaft to rotate said output shaft in a second direction opposite to said first direction for assisting movement of said door.

* * * * *